US010847867B2

(12) United States Patent
Dai

(10) Patent No.: US 10,847,867 B2
(45) Date of Patent: Nov. 24, 2020

(54) WINDOW ASSEMBLY WITH HEATING AND ANTENNA FUNCTIONS

(71) Applicant: David Dai, Novi, MI (US)

(72) Inventor: David Dai, Novi, MI (US)

(73) Assignee: Pittsburgh Glass Works, LLC, Pittsburgh, PA (US)

( * ) Notice: Subject to any disclaimer, the term of this patent is extended or adjusted under 35 U.S.C. 154(b) by 155 days.

(21) Appl. No.: 16/292,691

(22) Filed: Mar. 5, 2019

(65) Prior Publication Data

US 2019/0273302 A1 Sep. 5, 2019

Related U.S. Application Data

(60) Provisional application No. 62/638,504, filed on Mar. 5, 2018.

(51) Int. Cl.

| | |
|---|---|
| ***H01Q 1/12*** | (2006.01) |
| ***H01Q 13/10*** | (2006.01) |
| ***H05B 3/84*** | (2006.01) |
| ***H01Q 1/32*** | (2006.01) |
| ***H01Q 5/30*** | (2015.01) |

(52) U.S. Cl.

CPC ..... *H01Q 1/1278* (2013.01); *H01Q 1/325* (2013.01); *H01Q 5/30* (2015.01); *H01Q 13/10* (2013.01); *H05B 3/84* (2013.01)

(58) Field of Classification Search

None

See application file for complete search history.

(56) References Cited

U.S. PATENT DOCUMENTS

| | | | |
|---|---|---|---|
| 3,655,545 | A | 4/1972 | Gillery et al. |
| 3,962,488 | A | 6/1976 | Gillery |
| 4,707,700 | A | 11/1987 | Nagy |
| 4,768,037 | A | 8/1988 | Inaba et al. |
| 4,849,766 | A | 7/1989 | Inaba et al. |
| 4,864,316 | A | 9/1989 | Kaoru et al. |
| 4,898,789 | A | 2/1990 | Finley |
| 5,355,144 | A | 10/1994 | Walton et al. |
| 5,670,966 | A | 9/1997 | Dishart et al. |
| 5,898,407 | A | 4/1999 | Paulus et al. |

(Continued)

FOREIGN PATENT DOCUMENTS

DE 102012008033 A1 11/2012

*Primary Examiner* — Amy Cohen Johnson
*Assistant Examiner* — James H Cho
(74) *Attorney, Agent, or Firm* — Dentons Cohen & Grigsby P.C.

(57) ABSTRACT

A vehicle glazing with a slot antenna between the vehicle portal and the peripheral edge of an IR reflective coating that includes a heating bus over the coating edge. The antenna slot may be fed directly by a voltage probe or a coupled coplanar line at a position to excite both fundamental and higher order modes for multiband antenna applications. A portion of the IR reflective coating may overlay the window frame at null positions of first higher order mode to tune the slot antenna to higher frequencies. Slot antenna resonant frequency may also be moved higher by separating the IR reflective coating into two coating panel with the lower coating panel connected to electrical ground by capacitive coupling. Multiple antennas can be fed at different locations for multiband applications and diversity antenna systems.

36 Claims, 11 Drawing Sheets

(56) References Cited

U.S. PATENT DOCUMENTS

| | | | | |
|---|---|---|---|---|
| 7,764,239 | B2 | 7/2010 | Baranski | |
| 9,337,525 | B2 | 5/2016 | Dai | |
| 10,638,548 | B2 * | 4/2020 | Kagaya | H05B 3/84 |
| 2009/0128431 | A1 * | 5/2009 | Martin | B32B 17/10376 343/713 |
| 2015/0222006 | A1 * | 8/2015 | Dai | H01Q 13/10 343/712 |
| 2016/0134013 | A1 * | 5/2016 | Suenaga | H01Q 7/00 343/711 |
| 2017/0317399 | A1 | 11/2017 | Droste et al. | |

* cited by examiner

WINDOW ASSEMBLY WITH HEATING AND ANTENNA FUNCTIONS

TECHNICAL FIELD

The present invention relates generally to vehicle antennas and, more particularly, to an antenna formed in association with a glazing having an electrically heatable conductive coating.

BACKGROUND OF THE INVENTION

In recent years, window glazings with additional functions such as solar load reduction have become more popular in automotive vehicles and architectural structures. In order to reduce heat build-up in the interior of a vehicle or building, the glazing can be coated with a solar control film that reflects solar energy. Such solar control films are usually transparent, electrically conductive films. In addition, transparent, metallic film on window glazings may be used on vehicle windows in order to enable a flow of DC current across the window when applying a DC voltage to the metallic coating. Such embodiments are typically used to defrost (i.e., melt snow and ice) or defog the window.

In automotive transparencies, such as windshields and back windows, antennas for the reception and/or transmission of radio frequency waves such as AM, FM, TV, DAB, RKE, etc. are often mounted on or incorporated into the transparency. These antennas can be formed by printing conductive lines such as silver or copper onto the transparency or by metal wires or strips attached to the transparency. One of the consequences of using metallic coated windows is that they can attenuate the propagation of RF signals through the window. As a result, wireless communication into and out of buildings, vehicles, and other structures that use metallic coated windows to reduce heat load can be restricted. One solution for applications in which the metallic coating interferes with the propagation of signals through the window has been to remove a portion of the metallic coating that interferes with the antennas. Removal of the coating facilitates the transmission of RF signals through the portion of the window where the coating is removed. However, removal of the metallic coating tends to increase solar energy transmission into the interior of the vehicle, which can increase the vehicle temperature. Also, in some cases, removal of the metallic coating may break the DC current flow through the glazing and create non-heating zones on the glazing.

Some prior constructions have integrated antennas with the window. Antennas have been proposed that employ quarter wavelength or half wavelength antennas or slot antennas formed between the metal frame of a window and a conductive transparent film or coating. For example, U.S. Pat. Nos. 4,849,766; 4,768,037; 5,670,966; and 4,864,316 illustrate a variety of antenna shapes that are formed by a thin film on a vehicle window. U.S. Pat. Nos. 4,707,700; 5,355,144; 5,898,407; 7,764,239; and 9,337,525 disclose different slot antenna structures.

European patent application DE 10 2012 008 033 A1 discloses a motor vehicle window that is partially heatable with a heating device and that utilizes a portion of non-heated window as an antenna for transmitting and receiving electromagnetic waves. US patent application 2017/0317399 illustrates an electrically heatable window with an antenna. The antenna is fed at two locations with a top feed directly connected to a heatable coating while the bottom feed is capacitive coupled to a heating panel. However, improvements to these antenna are needed to meet advancing antenna performance demands for antenna gain, radiation pattern and antenna impedance characteristics.

With rapid development of vehicle electronics, more and more antennas have been required for vehicles. At FM and TV frequencies in particular, vehicle systems require a number of antennas for diversity operation to overcome multipath and fading effects. Currently, in most cases separate antenna and antenna feeds are used to meet the requirements of AM, FM, TV, weather Band, Remote Keyless Entry, and DAB Band III frequencies. Most of those are integrated into back window glass. Multiple coaxial cables running from the antenna to the receiver can be avoided by combining the separate antenna signals using an electrical network. Such a network, however, involves the added complexity and expense of a separate module. In order to limit complexity and expense of an on-glass antenna system, the number of antenna feeds should be limited. Therefore, it would be advantageous to provide an antenna, particularly an electrically heatable IR reflective hidden window antenna, with multiple frequency bands for different applications.

An objective of the present invention is to reduce number of antennas on the vehicle to simplify the antenna and associated electronics design through advanced antenna matching and frequency tuning methods. Preferably, the antenna meets system performance requirements while retaining all solar benefits of the heat reflective coating and excellent aesthetics.

SUMMARY OF THE INVENTION

The presently disclosed invention discloses a slot antenna that is suitable for use in vehicle applications. The disclosed antenna with a plurality of antenna feed methods has improved impedance matching and frequency tuning capability. The slot antenna affords improved performance in the VHF and UHF bands while also retaining the solar benefits of the heat reflective coating, window heating capability for defrosting, deicing, or defogging and excellent aesthetics.

The slot antenna is formed between the metal frame of a window and a layer of conductive transparent film or coating that is bonded to the window glazing. Two side edges of the coating are connected to high conductive buses that are connected to an external circuit. When a DC voltage is applied through the buses to the coating, an electric current flows through the conductive, transparent film and across the window to heat the window. When no electrical current moves through the coating, the coating functions as a solar control coating. Two conductive buses and the coating define an outer peripheral edge that is spaced from the inner edge of the window frame to form a slot antenna. The slot dimension is designed to support fundamental and higher order modes within frequency bands of interest. Preferably, the total slot length of an annular shaped slot is one wavelength for the fundamental excitation mode and two wavelengths for the first higher order excitation mode.

The slot antenna can be excited by a voltage source such as a balanced parallel transmission line that is connected to the opposite edges of the slot, or by a coaxial transmission line that is connected to the opposite edges of the slot. The slot antenna may also be fed by a coplanar line probe. In the coplanar line probe the inner conductor is extended along the center of the slot to form a coplanar transmission line, effectively giving a capacitive voltage feed. Energy applied to the slot antenna causes electrical current flow in the conductive coating, heating buses, and metal frame of the window. The electrical currents are not confined to the edges of the slot, but rather spread out over the conductive sheet and heating buses. Radiation then occurs from the edges and both sides of the conductive sheets and heating buses.

For a typical sedan car, the slot length on the rear window has first higher mode resonant at FM frequencies (76 MHz-108 MHz). For a car with a larger back window, the resonant frequency may be in the lower half of the FM frequency band. In order to move the first higher mode to resonate at the center of the FM band, part of the perimeter edge of the conductive coating is extended outwardly so that it overlays the edge of the window frame. This overlay is longitudinally located along the slot at a "null" location of the electrical field to minimize the loading effect on the first higher mode. The overlay of the extended coating edge and the edge of the window frame causes a short of the coating to the window frame through capacitive coupling. The resonant frequency of the first higher mode is shifted higher because the total length of the slot is reduced by the shorting of the coating to electrical ground. By adjusting the longitudinal position of the overlap along the slot and adjusting the dimension between the coating edge and the edge of the window frame, the resonant frequency of the first higher mode can be tuned to the center of the FM band for better antenna performance.

The resonant frequency of the first higher mode can also be tuned higher by separating the electrically conductive IR coating into two coating panels with the lower coating panel overlapping the window frame near the bottom of the glazing. This causes the bottom coating panel to be electrically grounded to the frame though capacitive coupling. The annular slot is then formed around the perimeter of top coating panel only, i.e. between the coating panel edge and window frame on the top and sides of the upper coating panel and between the bottom edge of upper coating panel and top edge of lower coating panel. Resonant frequency of the slot mode is shifted higher due to the reduced total slot length. Relative size of the two coating panels can be adjusted for tuning the resonant mode frequencies.

Antenna for the AM frequency (150 KHz-1710 KHz) is sensitive to electronic noise. Sources of such noise include the window heating circuit, break lights, signal turning lights and fan motors. The AM antenna has to be separated from the coating panel to reduce low frequency noise generated from electrical current on the coating when powered by a DC source. It is also necessary to space the AM antenna away from the edge of the window frame because the coupling capacitance between the AM antenna and ground reduces antenna sensitivity. Given limitations on space around the slot, the AM antenna may not meet performance requirements. A piece of coating on the top or bottom can be isolated from the heating panel and used as an AM antenna. In general, the AM antenna performs better when the antenna is located near the top of the window.

BRIEF DESCRIPTION OF THE DRAWINGS

For a more complete understanding of the disclosed invention, reference should now be had to the embodiments illustrated in greater detail in the accompanying drawings and described below by way of examples of the invention. In the drawings.

DETAILED DESCRIPTION OF THE INVENTION

Figure 1:
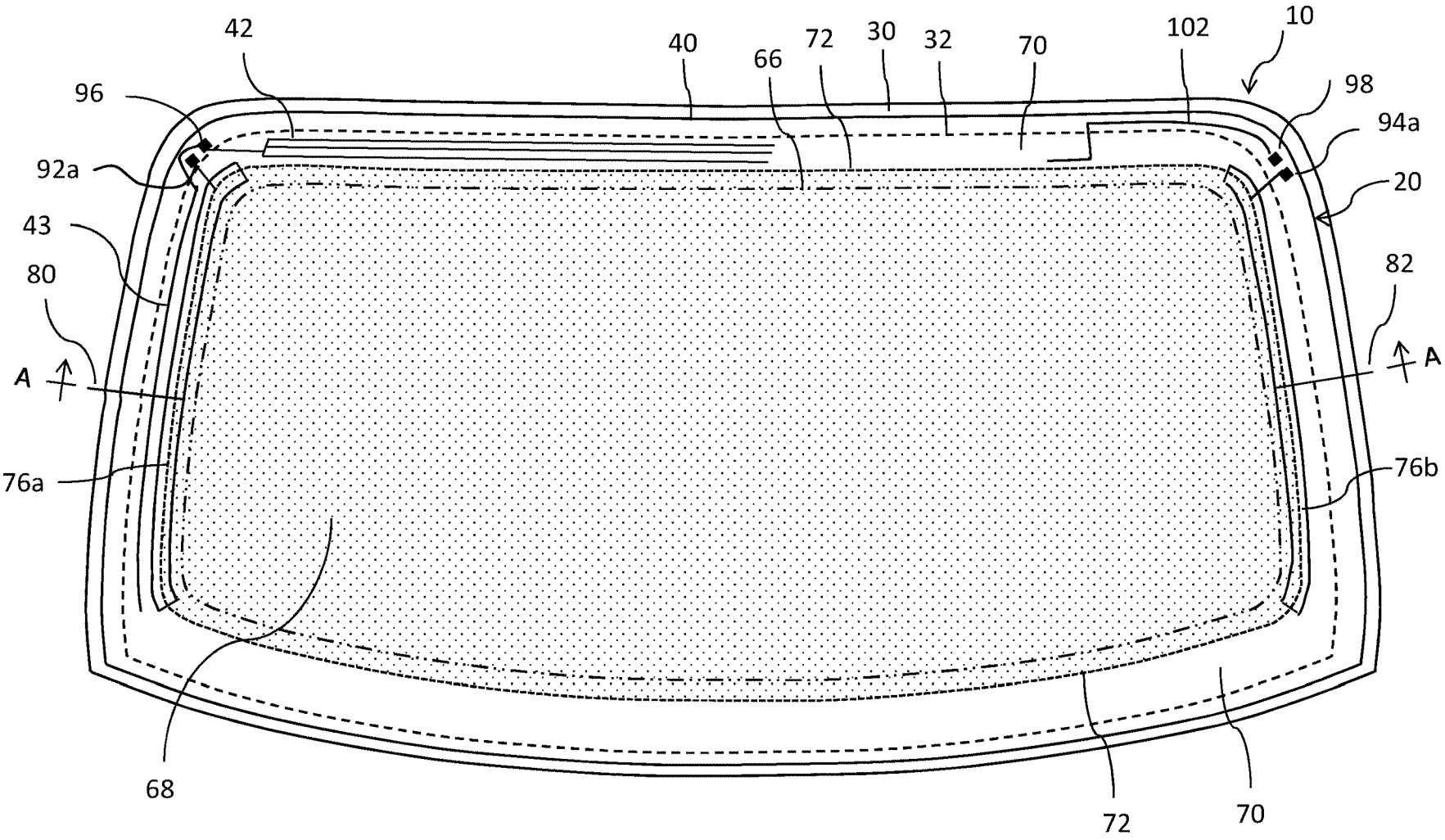
FIG. 1 is a diagram of a glazing incorporating features of the presently disclosed invention.

FIG. 1 is a plan view of antenna backlight 10 and associated structure incorporating features of the presently disclosed invention. A glazing 20 is surrounded by a metal frame that has a window aperture that is defined by window edge 32 of a body 30. The outer edge 40 of glazing 20 overlaps an annular flange formed by electrically conductive body 30 to provide, in this embodiment, a back window for the vehicle.

Figure 2:
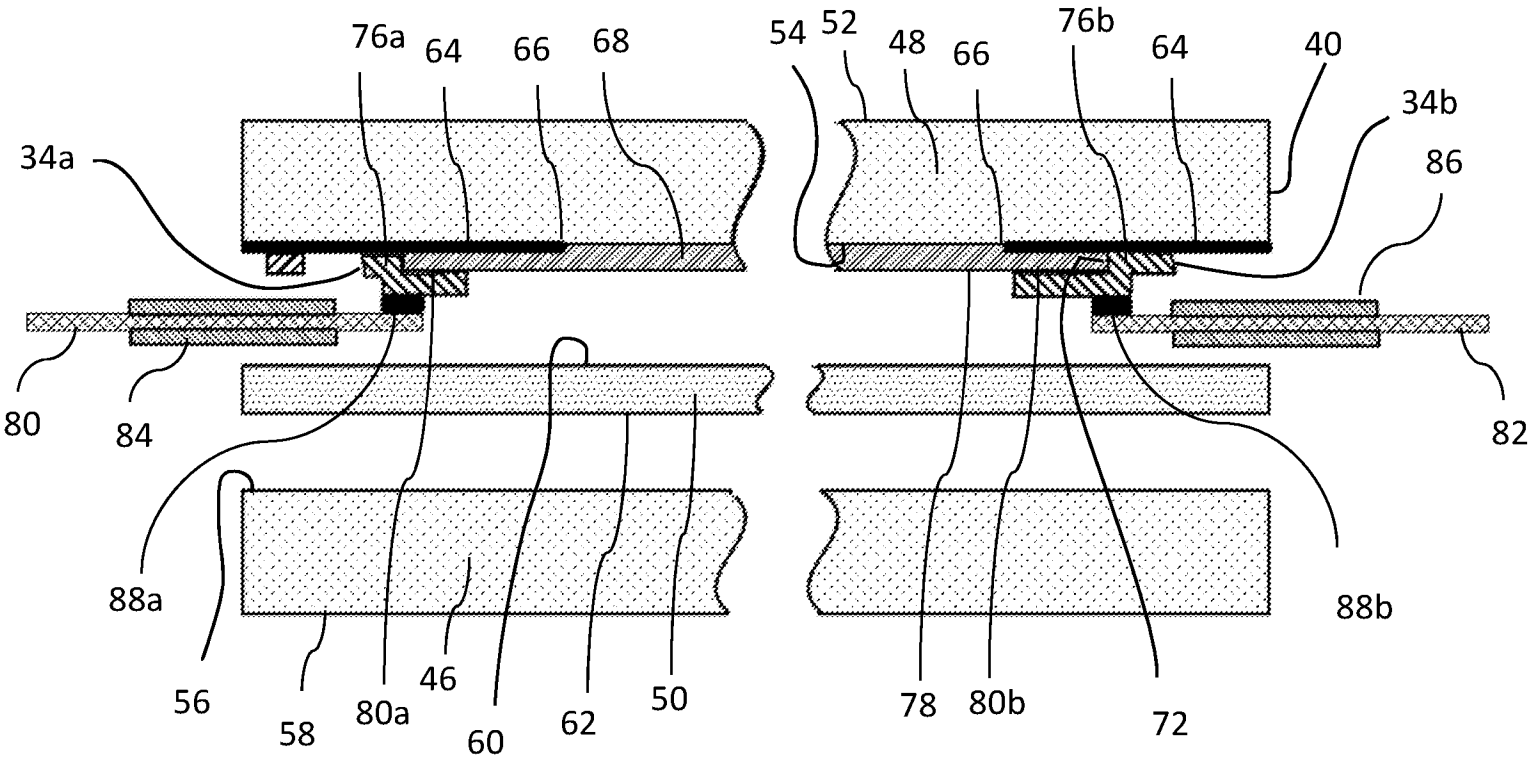
FIG. 2 is sectional view taken along line A-A in FIG. 1.

In the embodiment of FIGS. 1 and 2, glazing 20 is a laminated glazing that includes an inner transparent ply 46 and an outer transparent ply 48 that may be composed of glass. Inner ply 46 and outer ply 48 are bonded together by an interlayer 50. Preferably, interlayer 50 is made of polyvinylbutyral or similar material. Outer ply 48 has an outer surface 52 (conventionally referred to as the number 1 surface) that defines the outside of glazing 20 and an inner surface 54 (conventionally referred to as the number 2 surface). Inner surface 54 is oppositely disposed on outer ply 48 from outer surface 52. Inner ply 46 has an outer surface 56 (conventionally referred to as the number 3 surface) that faces internally on glazing 20 and an inner surface 58 (conventionally referred to as the number 4 surface) that defines the inside of glazing 20 and faces internally to the vehicle. Interlayer 50 defines an outer surface 60 that faces surface 54 of outer ply 48 and an inner surface 62 that is oppositely disposed on interlayer 50 from outer surface 60 and that faces surface 56 of inner ply 46. Backlite 10 is a laminated vehicle window formed of outer and inner glass plies 48 and 46.

As shown in FIG. 2, glazing 20 may include a concealment band 64 such as a paint band that is applied to outer ply 48 by screen printing opaque ink around the perimeter of surface 54 of outer ply 48 and then firing the perimeter of the outer ply. Concealment band 64 has a closed inner edge 66 that defines the boundary of the daylight opening (DLO) of glazing 20. Concealment band 64 is sufficiently wide to cover the antenna elements of the disclosed backlite as well as other apparatus that is included near the outer perimeter of glazing 20 as hereinafter shown and described.

Glazing 20 further includes an electro-conductive coating 68 that covers the daylight opening of glazing 20. Electro-conductive coating 68 reflects incident infrared solar radiation to provide a solar shield for the vehicle on which glazing 20 is used. Coating 68 reduces transmission of infrared and ultraviolet radiation through the glazing. Preferably, coating 68 is a semi-transparent electro-conductive coating that is applied on surface 54 of outer ply 48 (as shown in FIG. 2) or on surface 56 of inner ply 46 in accordance with processes well known in the art. Coating 68 is electrically conductive and may have single or multiple layers of metal-containing coating as, for example, disclosed in U.S. Pat. No. 3,655,545 to Gillery et al.; U.S. Pat. No. 3,962,488 to Gillery and U.S. Pat. No. 4,898,789 to Finley. Typically, coating 68 has a sheet resistance in the range of 1Ω/□ to 3Ω/□ and an optical transmission of about 75%.

A band of coating 68 is removed from surface 54 of outer ply 48 between outer perimeter 40 of glazing 20 and a deletion edge 72 of coating 68 to form a band 70. Coating 68 may be removed from glazing 20 either by mask deletion or laser deletion techniques. Removal of coating 68 in this way helps prevent corrosion at the perimeter of coating 68 and improves radio frequency transmission through glazing 20. Deletion edge 72 is laterally located on glazing 20 between the inner edge 66 of band 64 and perimeter edge 40 of glazing 20. Removal of coating 68 in this way provides the basic structure of an antenna slot when glazing 20 is received by conductive body 30 to cover the window aperture that is defined by window edge 32.

A high conductive heating bus 76*a* and 76*b* is screen printed onto a portion of concealment band 64 covering surface 54 of outer ply 48 and a portion of surface 78 of coating 68 such that heating bus 76*a* and 76*b* each cover a longitudinal segment of deletion edge 72 of conductive coating 68. Each of heating bus 76*a* and 76*b* overlays a portion of concealment band 64 and outer ply 48 that is adjacent deletion edge 72 and also overlays a portion of coating 68 that is adjacent deletion edge 72 such that each of heating bus 76*a* and 76*b* overlays a respective longitudinal segment of deletion edge 72. Within the respective segment of deletion edge 72 that heating bus 76*a* and 76*b* overlay, heating bus 76*a* and 76*b* also respectively overlay the surface of band 70 that is laterally adjacent deletion edge 72 of coating 68. In this way, heating bus 76*a* and 76*b* form respective metal strips that are electrically connected to coating 68 with a surface 80*a* of heating bus 76*a* contacting coating 68 and band 64 and a surface 80*b* of heating bus 76*b* also contacting coating 68 and band 64. Heating bus 76*a* cooperates with the electrically conducting member or body 30 and with the electrically conductive coating 68 to define a slot antenna between the edge 34*a* of the heating bus 76*a*, edge 72 of conductive coating 68 and peripheral edge 32 of electrically conducting body 30. Heating bus 76*b* cooperates with the electrically conducting member or body 30 and with the electrically conductive coating 68 to define a slot antenna between edge 34*b* of heating bus 76*b*, edge 72 of conductive coating 68, and peripheral edge 32 of the electrically conducive body 30.

Glazing 20 further includes a pair of flat conductive leads 80 and 82. One end of lead 80 is electrically connected to heating bus 76*a* by a solder member 88*a*. One end of lead 82 is electrically connected to heating bus 76*b* by a solder member 88*b*. The respective other end of conductive leads 80 and 82 can be electrically connected to opposite terminals of an external DC power source (not shown) to apply an electrical voltage between heating bus 76*a* and heating bus 76*b*. Electrical current flowing through metallic coating 68 in response to the voltage applied between heating buses 76*a* and 76*b* generates heat on outer ply 48 of the back window for de-frost or de-ice purposes. Preferably, flat conductive leads 80 and 82 are covered by plastic tape 84 and 86 or other electrical insulation so that it is electrically isolated from window frame or body 30 and does not short out the DC voltage at locations where it passes the window frame surface.

Glazing 20 and its associated body structures define an annular antenna slot 70 between the window frame edge 32 on one side and the heating bus edges 34*a* and 34*b* in combination with coating edge 72 of conductive coating 68 on the other side. The slot width must be sufficiently large that the capacitive effects across it at the frequency of operation are negligible so that the signal is not shorted out. The slot width is preferably greater than 10 mm. The preferred length of the slot for an annular shaped slot is an integer multiple of wavelength at the resonant frequency of application. The preferred length of the slot for a non-annular shaped slot is an integer multiple of one half of the wavelength with respect to resonant frequency of application. For a backlite 10 of a typical vehicle, the slot length is such as to resonate at fundamental mode and at first higher mode at the VHF band and also is useful for the TV VHF band and FM applications.

Figure 3:
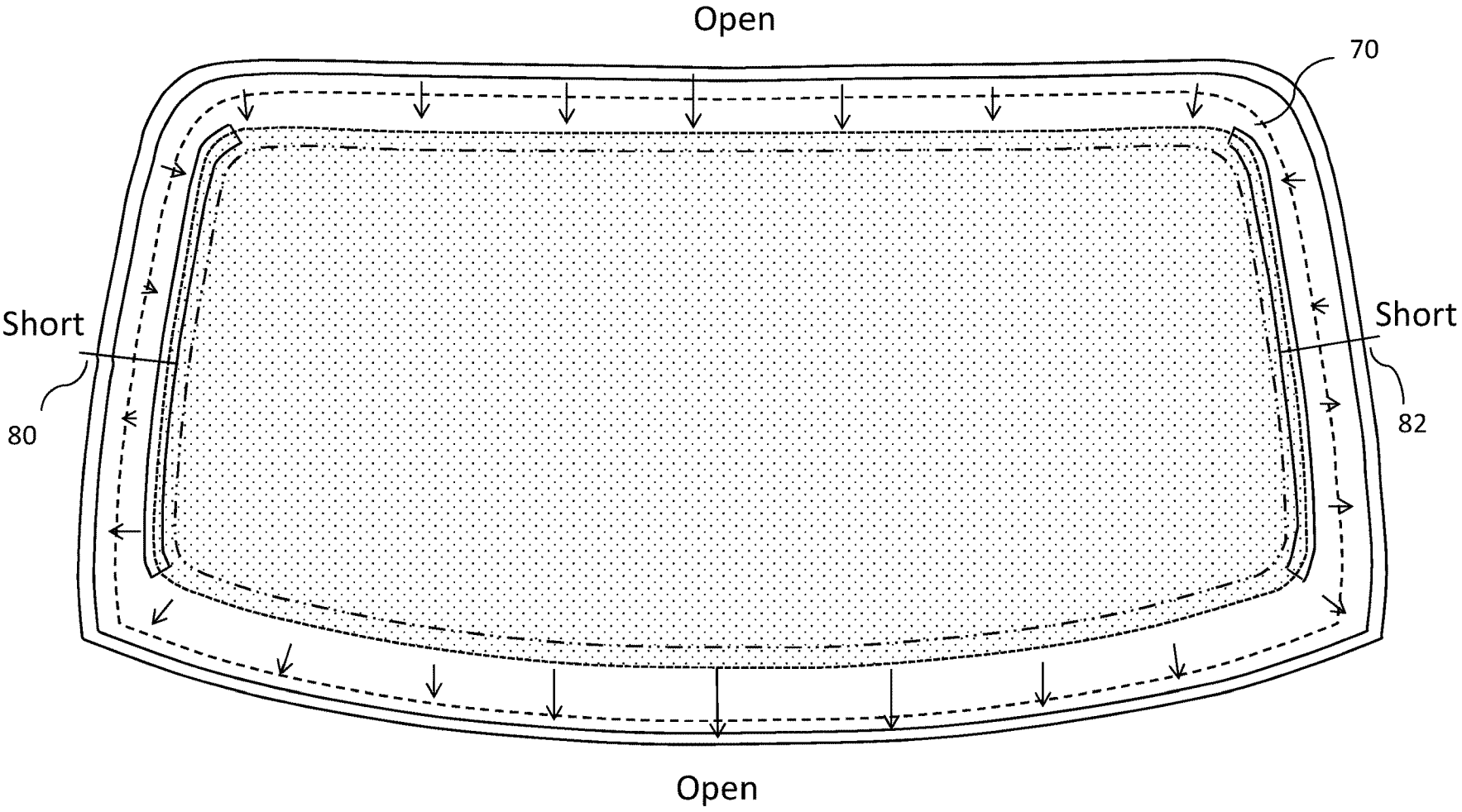
FIG. 3 illustrates an electrical field distribution of fundamental mode for a window antenna.
Figure 4:
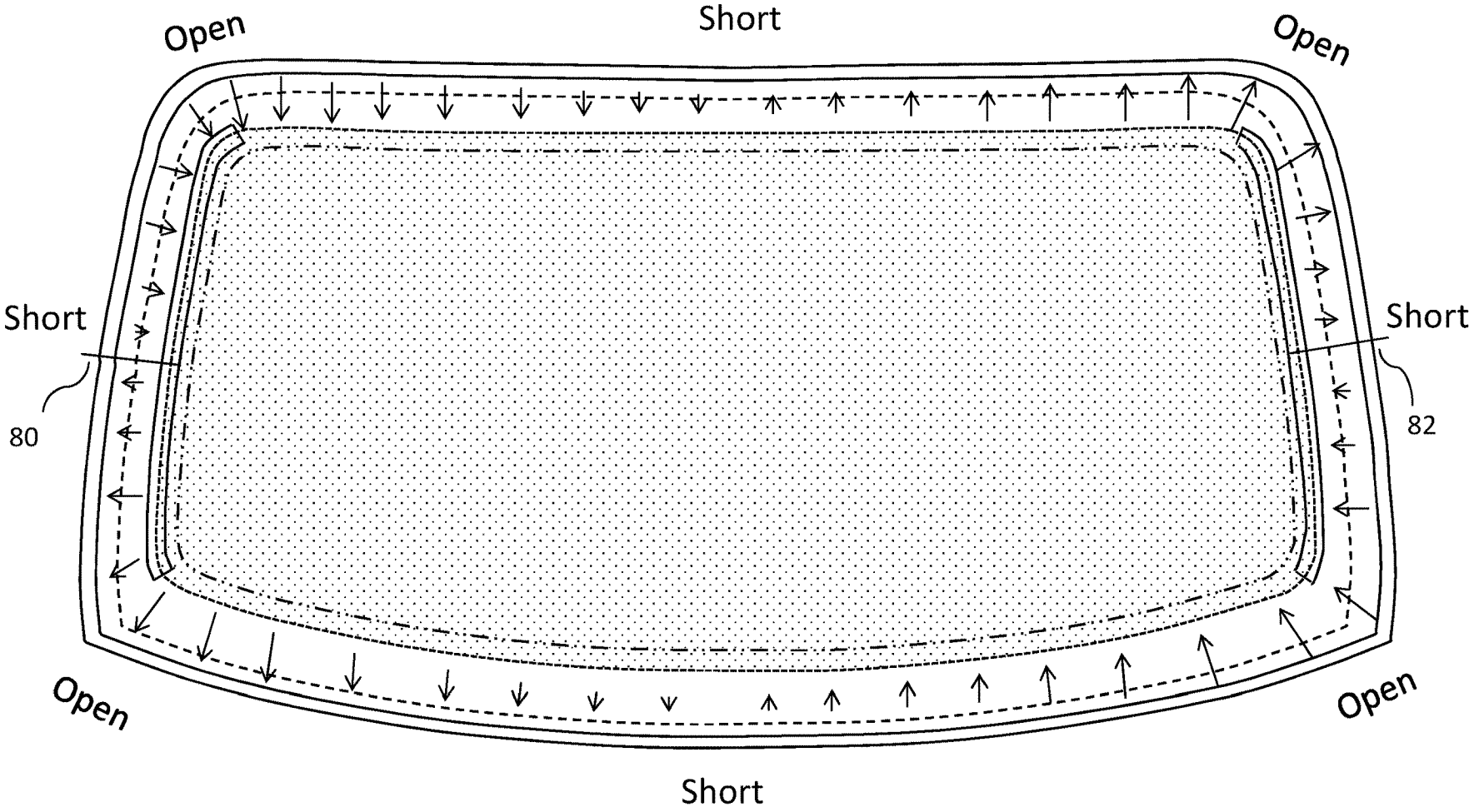
FIG. 4 illustrates an electrical field distribution of first higher mode for a window antenna.

FIG. 3 illustrates the field distribution of the fundamental mode with a maximum field strength (open) at the center of the top and bottom sides of the slot and a minimum field strength (short) at middle of the right and left sides of the slot. FIG. 4 shows the field distribution of the first higher mode which has a maximum field strength (open) at the corners of the slot and a minimum field strength (short) at middle of the slot at each of the top, bottom, right and left sides. The heating conductive leads 80 and 82 that connect to a DC power supply must be placed across the slot. If they are placed symmetrically in the middle of the right and left slot sides as shown in FIG. 3 and FIG. 4, the conductive leads 80 and 82 cross the slot at "short" points of both the fundamental mode and the first higher mode so that the fundamental mode and the first higher mode can be excited without significantly loading those modes from conductive leads 80 and 82. At times when no heating function is needed or when the heating leads 80 and 82 can be made to have high impedance by connecting to RF chocks, the "short" and "open" locations of the modes can be located in various longitudinal positions depending on the slot antenna feeding position and feeding conditions.

The slot antenna can be excited by a voltage source such as a balanced parallel transmission line that is connected to the opposite edges of the slot or by a coaxial transmission line that is connected to the opposite edges of the slot. FIG. 3 and FIG. 4 illustrate that the fundamental mode has a maximum near the center of the top and bottom sides of the slot, while the first higher mode has a minimum near the center of all four sides of the slot. Hence, feeding the slot antenna near the center position of the top or bottom sides with a voltage probe will excite only the fundamental mode. Placing the feed between minimum field strength positions of the first higher mode (e.g. at the corners) will excite both the fundamental and first higher order modes. The radiation pattern will differ depending on the particular combination of modes that is excited. At higher frequencies the slot is effectively longer and hence more than one mode can be excited from feed positions that are $\lambda/4$ apart.

Figure 5:
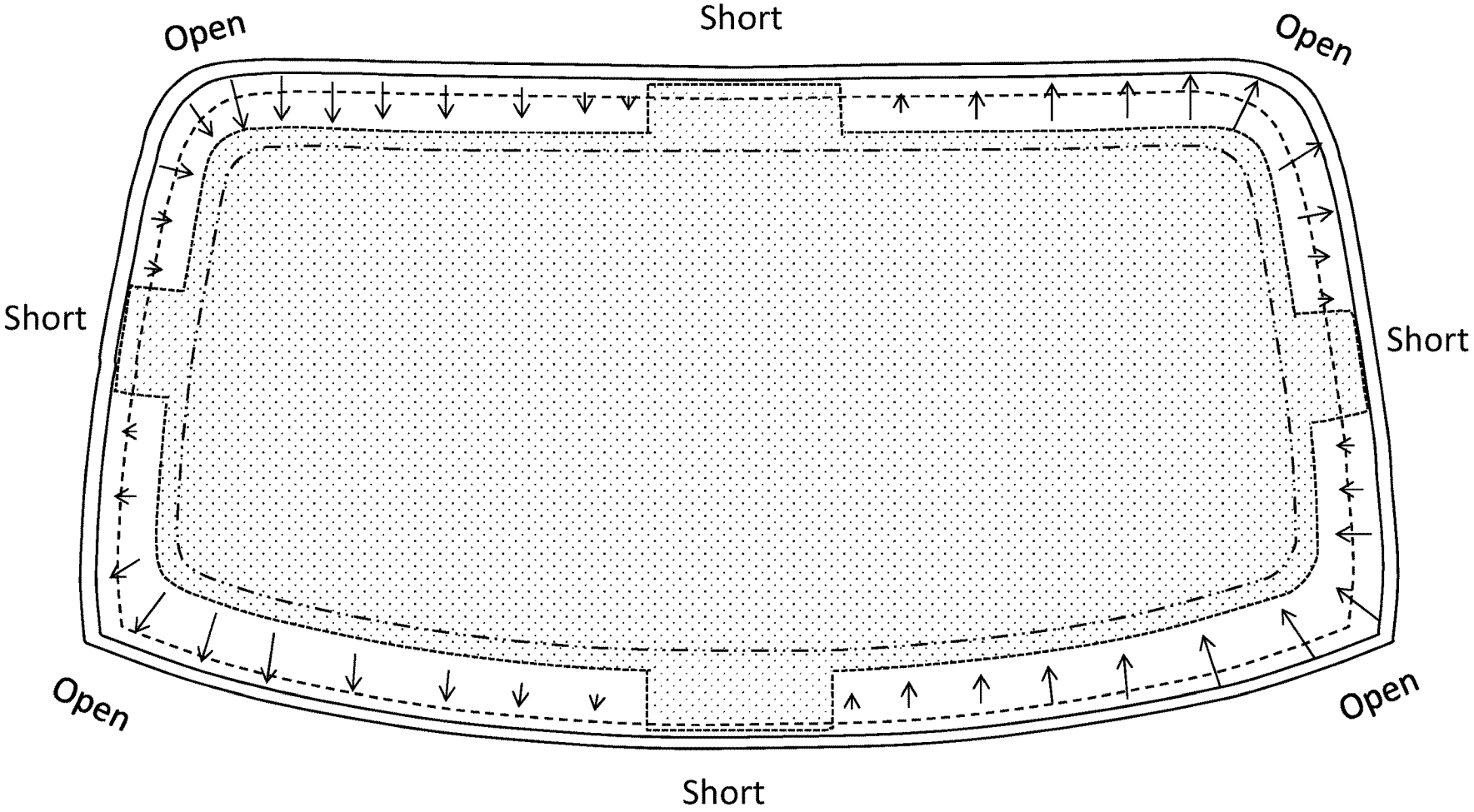
FIG. 5 illustrates an electrical field distribution of first higher mode for a window antenna with four shorting strips.
Figure 6:
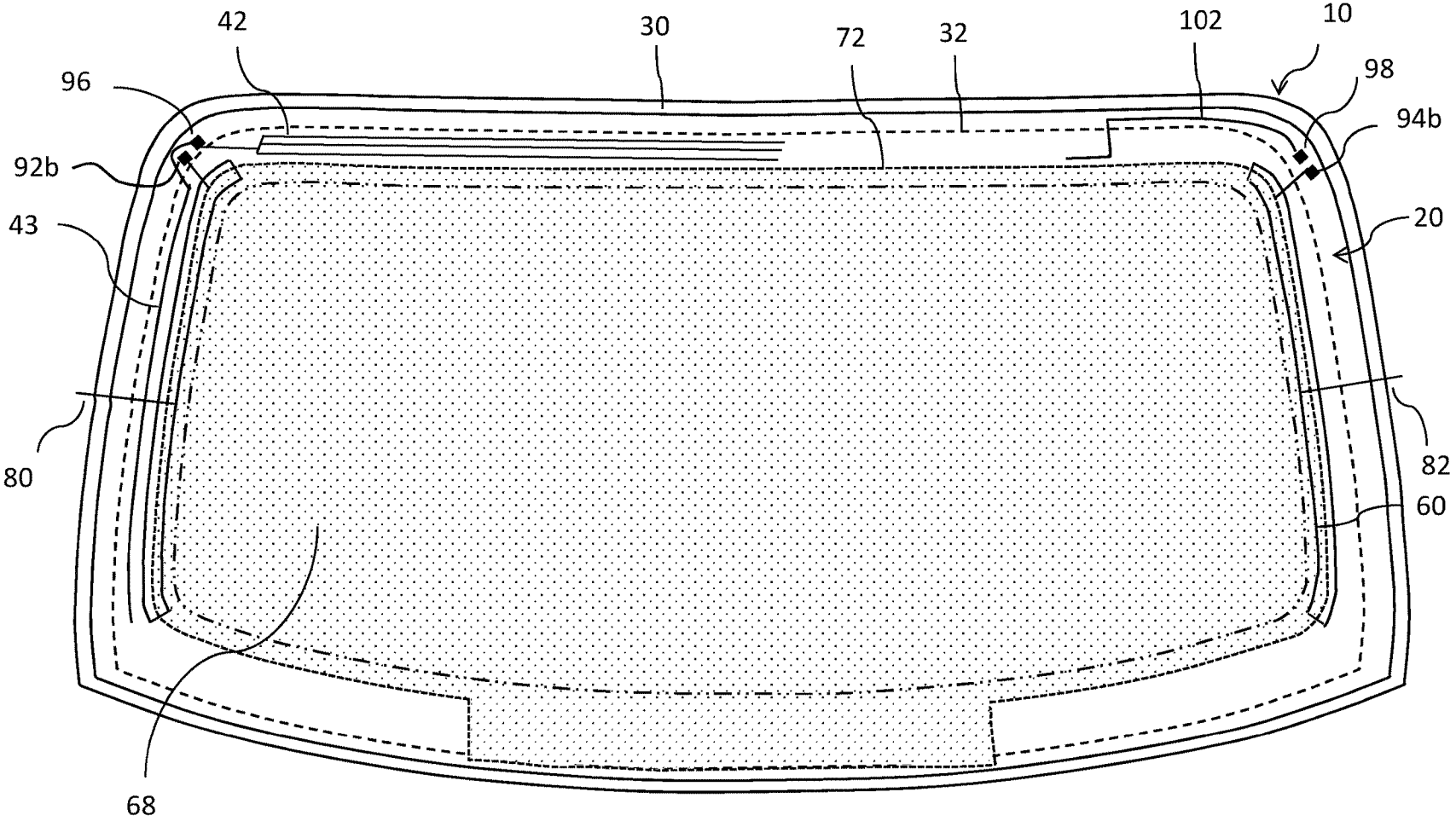
FIG. 6 is a diagram of a glazing in which a shorting strip is located near the bottom center of the glazing.

The resonant frequencies of the antenna fundamental mode and first higher mode are determined predominantly by the slot length which can be designed such that the antenna mode resonant frequencies coincide with the operation frequencies of typical vehicle electronics systems. For vehicles with large windows, the resonant frequencies of the slot antenna may be too low for such applications. In that case, the slot length can be shortened by overlapping the edge 32 of the vehicle frame 30 by one or more portions of the conductive coating 68 at locations near 'short' positions of the field strength. This is illustrated in FIG. 5 with four 'short' positions where portions of the peripheral edge of coating 68 are extended outwardly to overlap a liner segment (i.e. a portion of) window edge 32 at respective locations where the field strength minimums (i.e. "shorts") of the first higher order mode are located. FIG. 6 illustrates a window slot antenna that has a longer shorting overlap at a 'short' position near the bottom center for comparison to the linear segments of overlap that are illustrated in FIG. 5. Overlapping between coating 68 and window edge 32 as illustrated in FIGS. 5 and 6 causes the radio frequency signal to short to the vehicle frame through capacitive coupling. Because the overlapping occurs at 'short' positions for the first higher mode, it doesn't significantly load the slot antenna mode. However, because the overlapping is at the maximum field location (i.e. "open") for the fundamental mode, the fundamental mode is suppressed. For the first higher mode, the field distribution remains substantially the same along the slot antenna, but with shorter slot length. Selective overlapping by coating 68 in this way affords a technique for tuning the slot antenna to higher frequency bands for more precise antenna matching. In this way, window antennas in accordance with the disclosed invention can tune the antenna resonant frequency higher to accommodate the vehicle electronics system frequencies.

Figure 7:
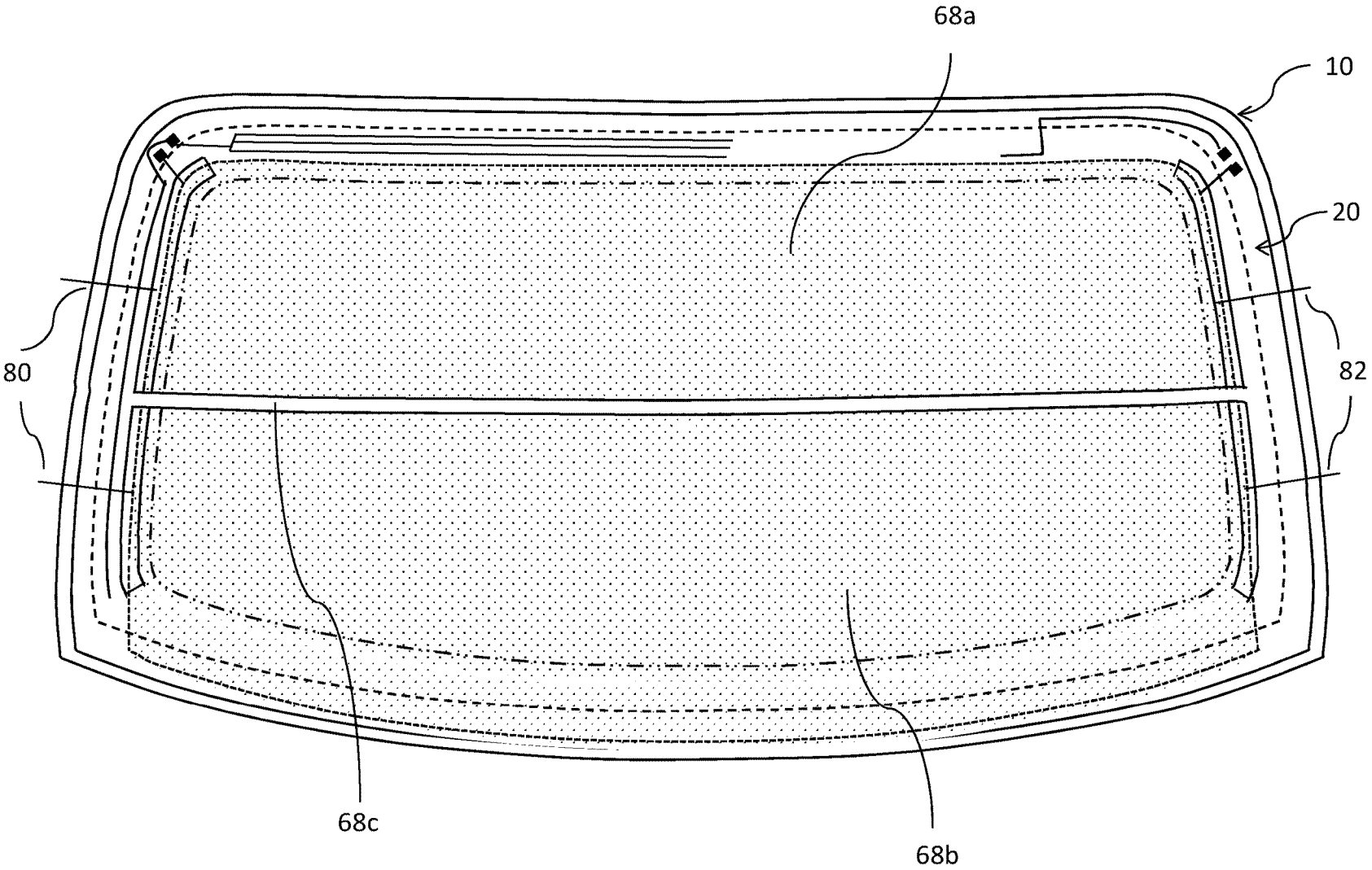
FIG. 7 is a diagram of a glazing in which the reflective coating panel is separated into two panels with portions of the bottom panel overlapping the window frame.

As illustrated in FIG. 7, the resonant frequency of the first higher mode can also be tuned higher by separating coating 68 into an upper coating panel 68*a* and a lower coating panel 68*b* that are separated by a slot 68*c* in which there is no electrically conductive coating. The bottom edge of lower coating panel 68*b* is extended to overlap the edge 32 of the window frame such that coating panel 68*b* is electrically grounded along the bottom edge to the window frame through capacitive coupling. An annular slot is formed only around the perimeter of coating panel 68*a*, i.e. between the window frame 30 and edges of coating panel 68*a* along the top and sides and along the slot between coating panel 68*a* and 68*b*. Resonant frequency of the slot mode is shifted higher in comparison to the slots of FIGS. 1 and 3 due to the shorter total slot length. Relative size of the two coating panels can be varied to further adjust and tune resonant mode frequencies. As shown in FIG. 7, two separate conductive leads 80 and 82 are required to connect to a DC power supply to heat the whole back window, i.e. panel 68*a* and panel 68*b* respectively.

The slot antenna can be excited by a voltage source such as a balanced parallel transmission line that is connected to the opposite edges of the slot, or by a coaxial transmission line that is connected to the opposite edges of the slot. As illustrated in FIG. 1, antenna 92*a* is fed by a short antenna feed line that is orthogonal to the antenna slot and connected to antenna pad and heating bus 76*a* from the side of the glazing to define the antenna feed point. A flat antenna connector (not shown) connects to the antenna pad at the feed point and then connects the antenna to an external module. At the feed point, the antenna feed voltage is equal to the aperture field voltage of the slot antenna at the longitudinal position of the feed point. Referring to the field distributions illustrated in FIG. 3 and FIG. 4, at antenna feed point 92*a* both fundamental mode and first higher mode can be excited because the longitudinal position of the feed point 92*a* along the slot is near maximum field strength (i.e. "open") for the first higher mode and away from the minimum field (i.e. "short") for the fundamental mode. The same is true for antenna 94*a* which is located at the glazing corner at the opposite side from antenna 92*a*. Antennas 92*a* and 94*a* are a quarter of wavelength apart for the fundamental mode so they are weakly coupled. Antenna 92*a* and 94*a* are also half wavelength apart at the first higher mode and therefore isolated from each other at the first higher order mode. Thus, they can be used simultaneously for a diversity antenna system. At UHF band, the higher order modes may be excited at various points a quarter wavelength apart to generate different antenna patterns, thus establishing pattern diversity. Antenna 92*a* and 94*a* have been designed for wideband applications for FM from 76 MHz to 108 MHz, DAB from 174 MHz to 240 MHz and TV UHF band from 470 MHz to 760 MHz. That requires the slot antenna to be excited for fundamental and first higher modes for FM and for higher order modes for DAB and TV frequencies.

The disclosed slot antenna can also be fed by a coupled coplanar line as shown in FIG. 1. Antenna 98 includes a coplanar line 102 that does not connect to the heating bus 76*b* or coating 68 so that coplanar line 102 effectively provides a capacitive voltage feed. Since coplanar line 102 is a distributed feed, coplanar line 102 may cross excitation points for both fundamental and higher order modes. Excitation of higher order modes is desirable for high frequency and multiband antenna applications such as TV antenna or antennas with multiple frequency bands.

Figure 10:
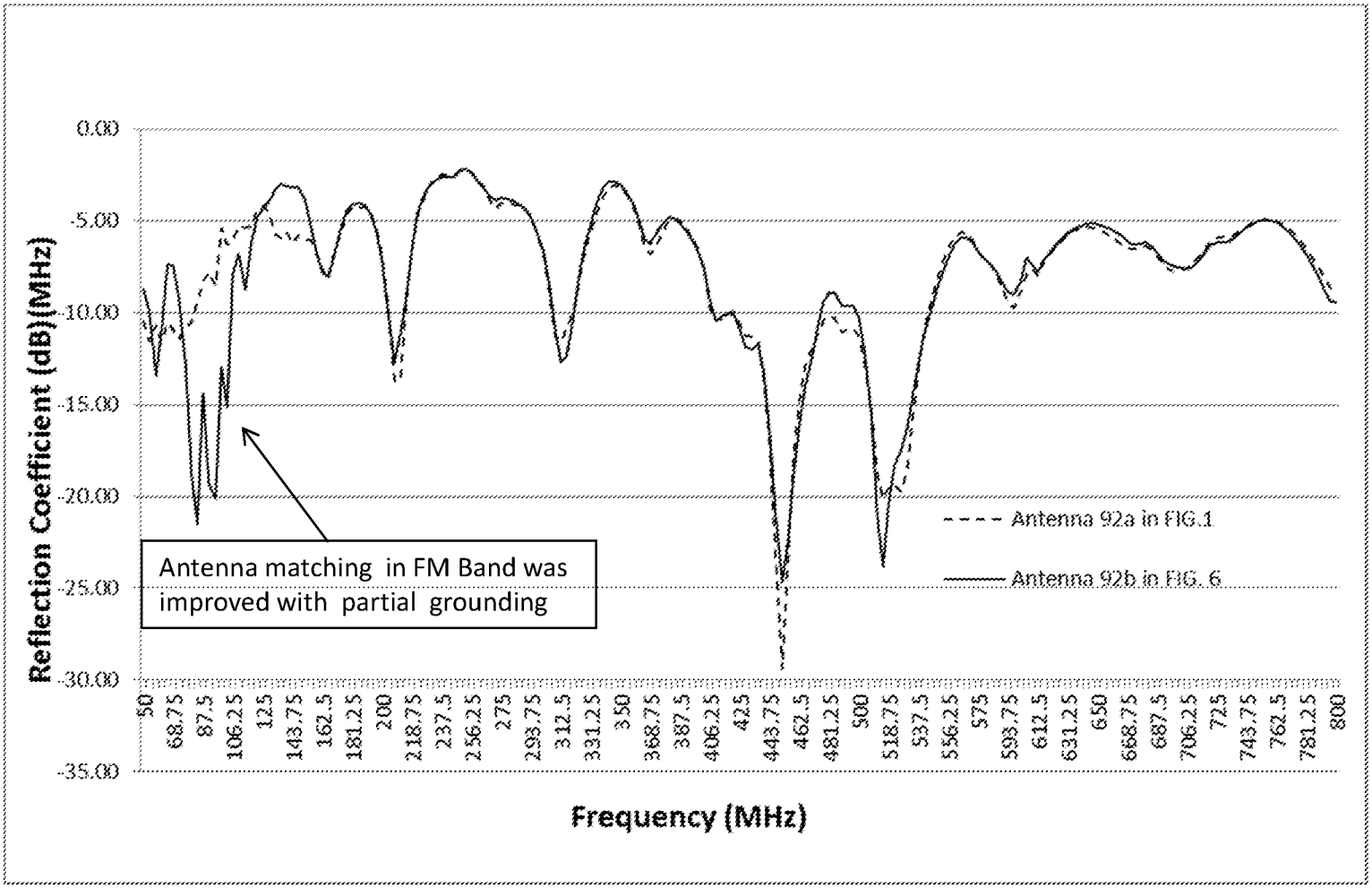
FIG. 10 is plot of the antenna return loss of antenna on left side of the glazing illustrating the antenna resonant frequency bands from 50 MHz to 800 MHz.
Figure 11:
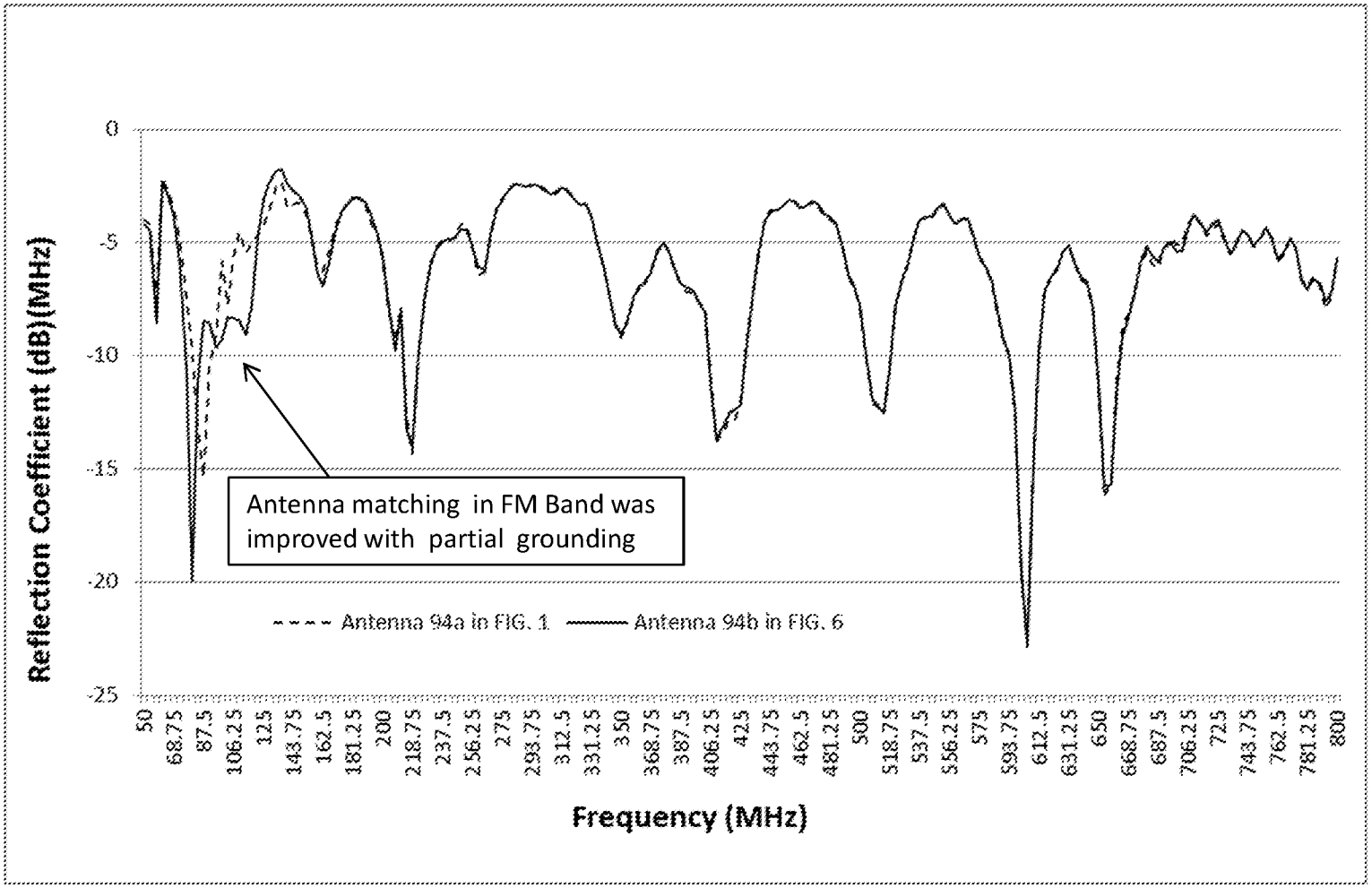
FIG. 11 is plot of the antenna return loss of antenna on right side of the glazing illustrating the antenna resonant frequency bands from 50 MHz to 800 MHz.

An embodiment similar to that illustrated in FIG. 1 with a voltage probe feed and a coupled coplanar line feed was constructed and tested on a vehicle. The dotted line in FIG. 10 and FIG. 11 shows the plot of the return loss (S11) of the slot antenna 92*a* and 94*a* respectively. Return loss is a measure of the power delivered to the antenna and reflected from the antenna verses the power that is "accepted" by the antenna and radiated. FIG. 10 and FIG. 11 show that the antenna resonates well in multiple frequency bands from 50 MHz up to 800 MHZ which covers FM/TV band II (76-108 MHz), TV band III (174 MHz-230 MHz), digital audio broadcasting (DAB III) (174 MHz-240 MHz), TV band IV and V (474 MHz-760 MHz). However, the FM band (76 MHz-108 MHz) is not fully covered by the antennas 92*a* and 94*a*. To improve antenna matching in the higher portions of the FM band, the conductive coating near the bottom center of the glazing is extended so that it overlaps the edge of window frame 30 as shown in FIG. 6. Overlapping the conductive coating and window frame edge in this way shorts the radio frequency signal to the vehicle frame through capacitive coupling. Because the overlapping occurs at weaker field strength ("short") positions of the first higher mode, it doesn't significantly load the first higher order slot antenna mode. The field distribution remains substantially the same for the first higher order mode along the slot antenna, but with shorter slot length. This affords a way to tune the slot antenna to higher frequency bands for better antenna matching with typical vehicle modules. The solid line in FIG. 10 and FIG. 11 represents the plot of the return loss (S11) of the slot antenna 92*b* and 94*b* respectively when the conductive coating near the bottom center of the glazing overlaps the edge 32 of window frame 30. FIGS. 10 and 11 show significant improvement in return loss in the FM band. Since the overlapping of coating 68 and window edge 32 applies primarily only to the first higher order mode (FM), all other modes maintain nearly the same response as shown in FIG. 10 and FIG. 11. Results of far-field gain measurements show the antenna performs very well at all bands including FM, DAB and TV. The slot antenna demonstrates the capability for multi-band application which can reduce the required number of antennas, simplify antenna amplifier design, and reduce overall costs of the antenna system.

Figure 8:
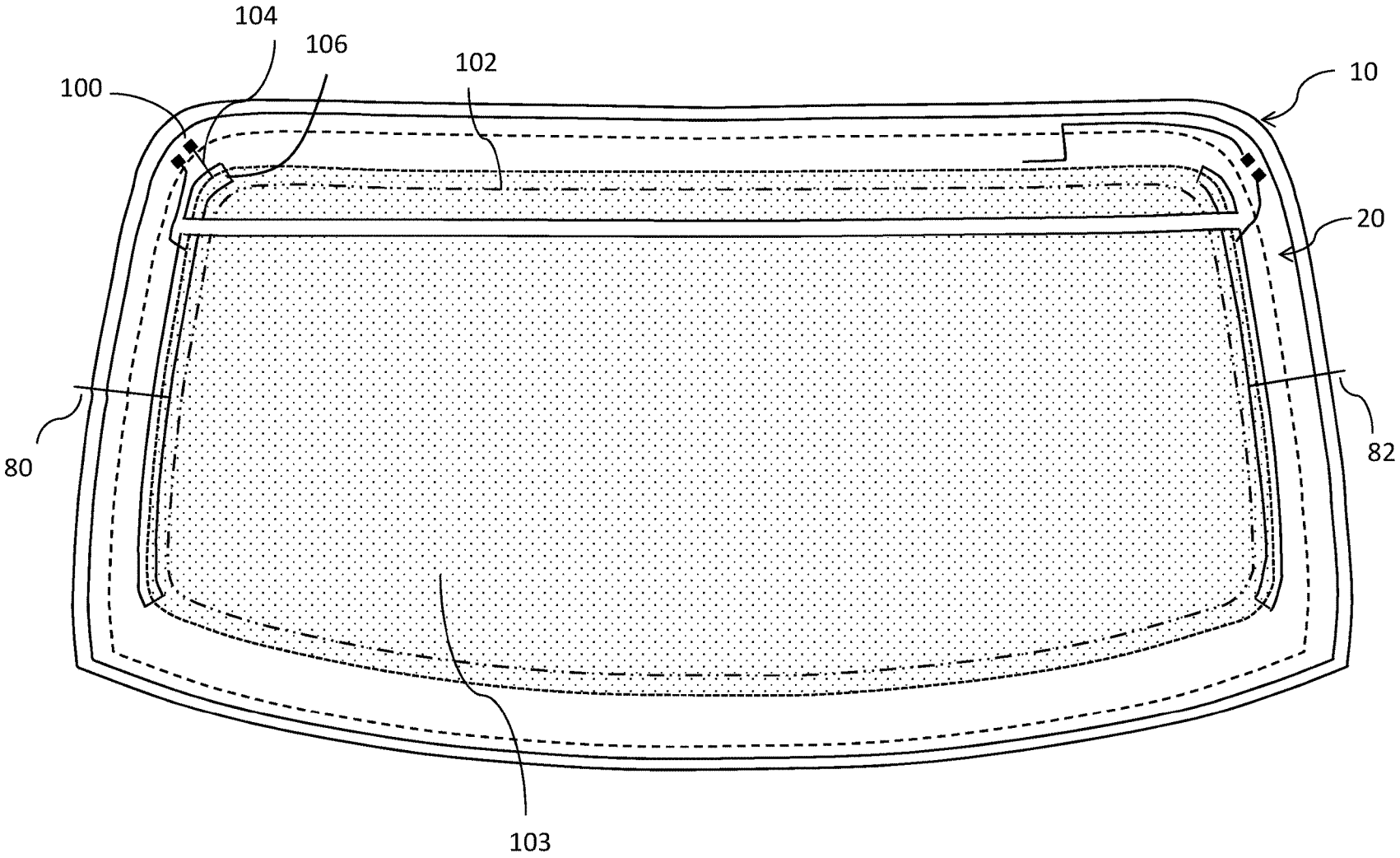
FIG. 8 is a diagram of a glazing in which a separate AM antenna is located near the top of the glazing.
Figure 9:
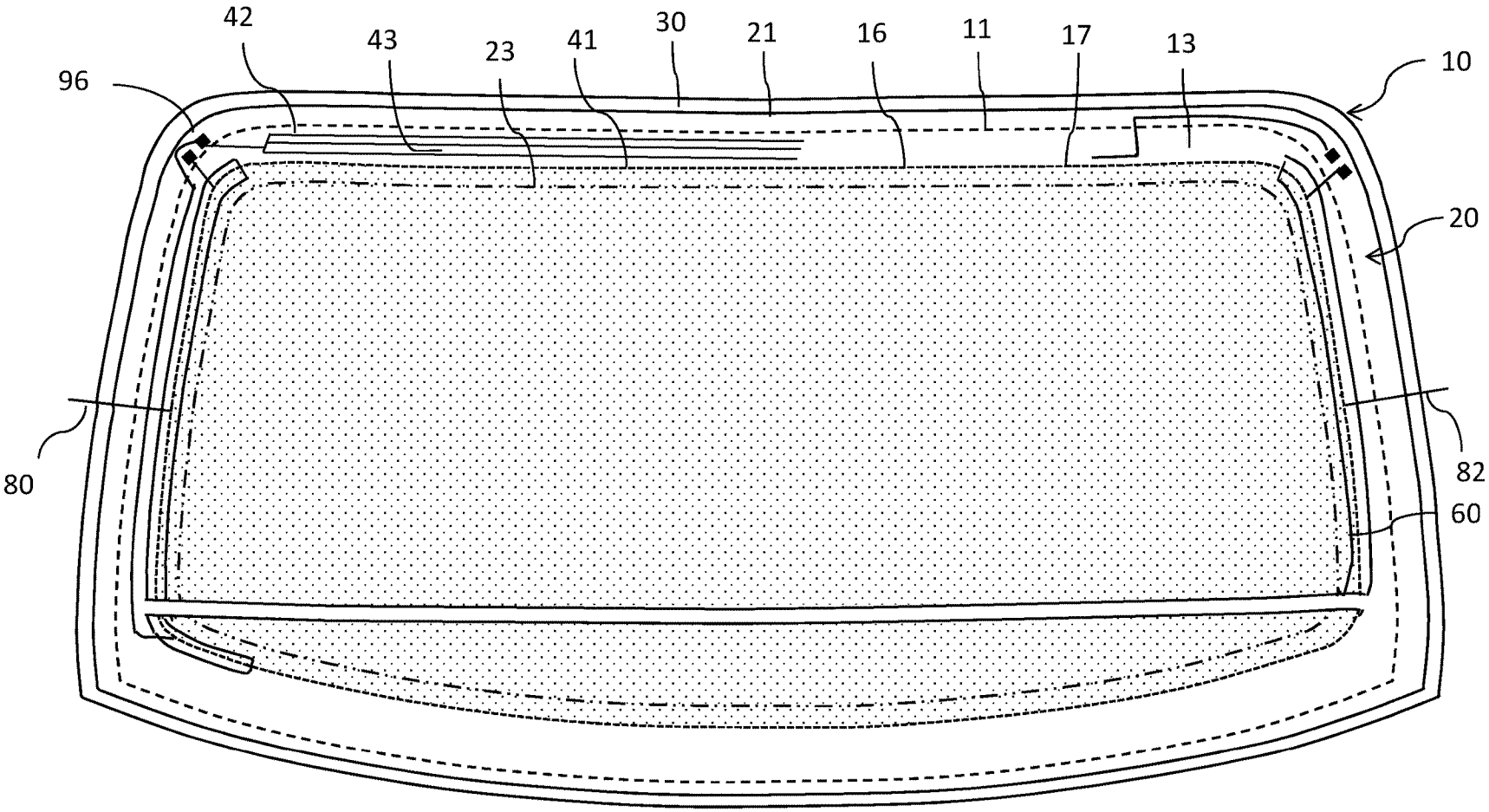
FIG. 9 is a diagram of a glazing in which a separate AM antenna is located near the bottom of the glazing.

Antenna 96 as shown in FIG. 1 is intended for AM reception (150 KHZ-1710 KHZ). AM antenna 96 has to remain apart from window frame 30 to reduce shunt capacitance load which reduces antenna sensitivity. On the other hand AM antenna 96 is sensitive to electronic noise. Sources of such electronic noise include the window heating circuit, break lights, signal turning lights and fan motors. These constraints limit the location of AM antenna 96 to between coating edge 72 and the edge of window frame 32. AM antenna 96 shown in FIG. 1 is composed of two portions. A first portion includes three horizontal lines 42 that are connected to a single line that is connected to an antenna connection pad. A second portion of AM antenna 96 is a vertical line 43 that is connected to the connection pad of AM antenna 96. Depending on the glass size and slot width between conductive coating edge 72 and window frame edge 32, the AM antenna may not meet certain performance requirements. To improve AM antenna performance, a portion of conductive coating 68 may be separated and used as an AM antenna as shown in FIG. 8. FIG. 8 includes a conductive coating that is separated into an upper panel 102*a* and a lower panel 103. AM Antenna 100 includes a conductive trace 104 and antenna bus 106. Antenna bus 106 is electrically connected to conductive coating 102*a* which is the upper portion of conductive coating 68. AM antenna is separated from the coating panel 103 with sufficient gap to reduce low frequency noises generated from electrical current on the coating when powered by a DC source. Laser deletion is preferred to separate the AM antenna. Laser deletion is less apparent visually and the size and pattern of the laser deletion window can be designed and precisely controlled to meet performance requirements. An AM antenna can also be constructed with the bottom portion of coating panel 68 isolated and connected to the AM antenna 96 as shown in FIG. 9. In general, the AM antenna performs better when the antenna is located near the top of the glazing.

While the invention has been described and illustrated by reference to certain preferred embodiments and implementations, it should be understood that various modifications may be adopted without departing from the spirit of the invention or the scope of the following claims.

What is claimed is:

1. An antenna that is included in a window assembly that is receivable in a frame member that is electrically conductive and that has an edge that defines a window opening, said antenna comprising:

at least one ply having a surface that is defined by an outer perimeter edge;

an optically transparent electrically conductive coating that is located on the surface of said ply, said electrically conductive coating having an outer peripheral edge with at least a portion of said outer peripheral edge being spaced inwardly from the outer perimeter edge of said ply;

a first heating bus that has greater electrical conductivity than the electrical conductivity of said electrically conductive coating, said first heating bus being located partly on an edge of said electrically conductive coating and partly over the surface of said ply, said first heating bus having a first edge such that, at times when said window assembly is received in said frame member, said first edge of said first heating bus is spaced laterally between the outer peripheral edge of said electrically conductive coating and the edge of said frame member, said first heating bus cooperating with said frame member and with said electrically conductive coating to define a slot antenna;

a second heating bus that has greater electrical conductivity than the electrical conductivity of said electrically conductive coating, said second heating bus being located partly on an edge of said electrically conductive coating and partly over the surface of said ply, said second heating bus being located oppositely on said electrically conductive coating from said first heating bus and having a first edge such that, at times when said window assembly is received in said frame member, said first edge of said second heating bus is spaced laterally between the outer peripheral edge of said electrically conductive coating and the edge of said frame member, said second heating bus cooperating with said frame member and with said electrically conductive coating to define the slot antenna;

a first electrical conductor that electrically connects to said first heating bus and a second electrical conductor that electrically connects to said second heating bus, said first electrical conductor also being connectable to one terminal of a DC voltage source and said second electrical conductor also being connectable to a second terminal of said DC voltage source that has opposite electrical polarity from said first terminal so that at times when the first electrical conductor and the second electrical conductor are connected to the DC voltage source, an electric current flows through said electrically conductive coating to heat said ply; and an antenna feed line that is located on said ply and that electrically connects to one of said first heating bus or said second heating bus.

2. The antenna of claim 1 wherein said first heating bus also has a second edge that is spaced laterally inwardly from the outer peripheral edge of said electrically conductive coating such that said first heating bus overlaps at least a partial length of the outer peripheral edge of said electrically conductive coating, and wherein said second heating bus also has a second edge that is spaced laterally inwardly from the outer peripheral edge of said electrically conductive coating such that said second heating bus overlaps at least a partial length of the outer peripheral edge of said electrically conductive coating.

3. The antenna of claim 2 wherein said first heating bus and said second heating bus cooperate with the peripheral edge of said electrically conductive coating to define one side of said slot antenna and wherein the edge of said frame member defines the opposite side of said slot antenna.

4. The antenna of claim 3 wherein said antenna feed line crosses the first edge of one of said first bus or said second heating bus and also crosses the edge of said frame member.

5. The antenna of claim 3 wherein accordance with the dimension and location of said antenna feed line, the location of said heating bus, the length of the slot antenna, the gap between the first edge of said first heating bus and the edge of said frame member, and the gap between the first edge of said second heating bus and the edge of said frame member determine the impedance of said slot antenna at different modes.

6. The antenna of claim 3 wherein said slot antenna is fed by a voltage probe or a coaxial cable with the outer conductor of said coaxial cable being connected to said frame member and the center conductor of said coaxial cable being connected to said feed line and also connected to said heating bus.

7. The antenna of claim 3 wherein said slot antenna is fed by a coupled coplanar line, said coupled coplanar line being laterally spaced between the first edge of said first heating bus and the edge of said frame member or between the first edge of said second heating bus and the edge of said frame member.

8. The antenna of claim 3 wherein said slot antenna has a fundamental mode with a maximum field strength located longitudinally along said slot antenna at the center of portions of said slot antenna that are oppositely disposed on said electrically conductive coating and wherein said first and second electrical conductors are longitudinally located along said slot antenna at locations of minimum field strength of said slot antenna.

9. The antenna of claim 3 wherein said slot antenna defines upper and lower sides that are connected by left and right sides, said upper and lower side cooperating with said left and right sides to form corners between said sides, said slot antenna having a first higher mode with a maximum field strength in the corners of said slot antenna and said first and second electrical conductors being longitudinally located along said slot antenna locations of at minimum field strength of said slot antenna.

10. The antenna of claim 9 wherein said optically transparent electrically conductive coating has a peripheral edge that partially overlaps said frame member at the longitudinal location of minimum field strength, said optically transparent electrically conductive coating being electrically connected to said frame member through capacitive coupling at said minimum field strength locations.

11. The antenna of claim 10 wherein the electrical connection of said optically transparent electrically conductive coating to said frame member at minimum field strength locations does not change field distribution along said slot antenna and wherein the slot length of said slot antenna is shortened through capacitive coupling to cause the resonant frequency of said slot antenna to shift higher.

12. The antenna of claim 3 wherein said antenna feed line is connectable to said antenna feed point at any location along said first heating bus or said second heating bus.

13. The antenna of claim 3 wherein said antenna feed line is located laterally between the first edge of said first heating bus or said second heating bus heating bus and the perimeter edge of said ply to define an antenna design.

14. The antenna of claim 13 wherein said window assembly includes a plurality of antenna designs, the antenna feed line for each respective antenna having a lateral location between the first edge of said first heating bus or said second heating bus and the perimeter edge of said ply to define the respective antenna design.

15. An antenna for use in a vehicle that includes an electrically conducting member having an inner edge that defines a window opening, said antenna comprising:

(a) a window assembly that is configured to be received over said window opening, said window assembly including:

at least one transparent ply having a surface that is defined by an outer edge;

an optically transparent electrically conductive coating that is located on the surface of said transparent ply, said electrically conductive coating having an outer peripheral edge with at least a portion of said outer peripheral edge being spaced laterally inwardly from the inner edge of the electrically conducting member of said vehicle;

a heating bus that is located partially on the surface of said transparent ply, said heating bus having greater electrical conductivity than the electrical conductivity of said transparent electrically conductive coating, said heating bus having a first portion and a second portion with each of said first and second portions respectively having a first edge that is spaced laterally between the outer peripheral edge of said electrically conductive coating and the inner edge of the electrically conducting member of said vehicle, each of said first and second portions of said heating bus also respectively having a second edge with at least a portion of said second edge being laterally spaced inwardly from the outer peripheral edge of said electrically conductive coating and over said electrically conductive coating such that said portion of said heating bus overlaps at least a portion of the outer peripheral edge of said electrically conductive coating, said heating bus cooperating with said electrically conducting member and with said electrically conductive coating to define a slot antenna between the first edge of said heating bus and the inner edge of said electrically conducting member;

an antenna feed line that is located on said transparent ply between the first edge of said heating bus and the inner edge of said electrically conducting member; and an antenna feed point that electrically connects said antenna feed line to said heating bus;

(b) a first heating wire that is electrically connected to the first portion of said heating bus at the midpoint between opposite ends of said first portion of said heating bus and a second heating wire that is electrically connected to the second portion of said heating bus at the midpoint between opposite ends of the said second portion of said heating bus;

(c) an antenna feed cable that is electrically connected to said antenna feed line; and (d) an electrical ground between said antenna feed cable and the electrically conducting member of said vehicle.

16. The antenna of claim 15 further comprising a band of opaque coating around the perimeter of the window assembly, said antenna feed being located laterally within the width of said band of opaque coating.

17. The antenna of claim 15 wherein said slot antenna has a slot width that is sufficient to negate capacitive effects across the slot antenna at the operation frequencies.

18. The antenna of claim 15 wherein the antenna feed point of said window assembly comprises an electrically conductive line that is connected to the antenna feed line and to the heating bus.

19. The antenna of claim 15 wherein said heating bus is electrically connected to said electrically conductive coating.

20. The antenna of claim 15 wherein said slot antenna has an annular configuration and the slot length of said slot antenna is one wavelength at the fundamental excitation mode.

21. The antenna of claim 15 wherein said slot antenna has an annular configuration and the slot length of said slot antenna is two wavelengths at the first higher excitation mode.

22. The antenna of claim 15 wherein said slot antenna defines an upper portion and a lower portion that are connected on respective ends by a left side portion and that are connected on opposite respective ends by a right side portion, said fundamental mode having a maximum field strength in the center of the upper portion of said slot antenna and in the center of the lower portion of said slot antenna, and wherein said first and second heating wires cross said slot antenna at respective minimum field strength locations.

23. The antenna of claim 22 wherein said upper and lower portions of said slot antenna cooperate with said left and right portions of said slot antenna to define corners of said slot antenna between said left portion and said upper and lower portions and between said right portion and said upper and lower portions, a first higher mode having a maximum field strength in the corners of said slot antenna and said heating wire crossing said slot antenna at the location of minimum field strength.

24. The antenna of claim 15 wherein said optically transparent electrically conductive coating has a peripheral edge partially overlaps said frame member at longitudinal locations of minimum field strength of said first higher mode, said optically transparent electrically conductive coating being electrically connected to the said frame member through capacitive coupling at the location of said minimum field strength.

25. The antenna of claim 24 wherein said optically transparent electrically conductive coating is electrically connected to said frame member at longitudinal locations of minimum field strength wherein such electrical connection does not change field distribution of said slot antenna even though the effective slot length of said slot antenna is shortened such that the resonant frequency of said slot antenna is shifted higher for more closely match the antenna in the FM, DAB or TV frequency bands.

26. The antenna of claim 25 wherein said slot antenna can be fed by a voltage probe or by a coaxial cable with the outer conductor of said coaxial cable being connected to said conductive member of said vehicle and the center conductor of said coaxial cable being connected to said feed line and said heating bus.

27. The antenna of claim 26 wherein said voltage probe crosses voltage excitation points for fundamental and higher order modes, the excitation of higher order modes being desirable for high frequency and multiband antenna applications including FM, DAB, TV antenna or antennas with more than one frequency band.

28. The antenna of claim 15 wherein said slot antenna is fed by a coupled coplanar line that is laterally spaced between the first edge of said heating bus and the edge of said conductive frame of said vehicle.

29. The antenna of claim 28 wherein the dimensions of said coupled coplanar line are selected to match the slot antenna impedance to the impedance of an input device.

30. The antenna of claim 29 wherein said probe voltage and coupled coplanar line are configured to feed the antenna at pre-selected longitudinal positions on the perimeter of said window assembly.

31. The antenna of claim 28 wherein said coupled coplanar line slot antenna feed excites both the fundamental mode and higher-order modes in the VHF and UHF bands for multiband applications.

32. The antenna of claim 15 wherein said slot antenna has a single feed and is operative in a frequency band from 76 MHz to 108 MHz for FM, 174 MHz to 240 MHz for DAB, 470 MHz to 760 MHz for TV applications.

33. The antenna of claim 15 wherein said slot antenna is fed from multiple voltage probes and coplanar feed lines that are respectively located at different longitudinal positions on said slot antenna to provide an antenna diversity system that excites different modes of the slot antenna to provide different respective field distributions.

34. The antenna of claim 15 wherein said optically transparent electrically conductive coating is electrically separated into top and bottom panels with the periphery edge of said bottom panel extending to overlap the edge of said frame member, said overlapping of the electrically conductive bottom panel and said frame member forming an electrical ground connection.

35. The antenna of claim 34 wherein said top panel has a shorter periphery edge in comparison to the periphery edge of the top and bottom conductive coating panels Such that the resonant frequency of said slot antenna is shifted to higher frequencies that more closely match FM, DAB or TV frequencies.

36. The antenna of claim 34 wherein the area of said top panel or said bottom panel is selected for use as an AM antenna.

* * * * *